United States Patent [19]

Repetto

[11] 4,444,028

[45] Apr. 24, 1984

[54] MACHINE FOR SPLITTING SKINS

[75] Inventor: Silvio Repetto, Modena, Italy

[73] Assignee: S.p.A. Luigi Rizzi & C., Modena, Italy

[21] Appl. No.: 321,617

[22] Filed: Nov. 16, 1981

[30] Foreign Application Priority Data

Nov. 19, 1980 [IT] Italy ..... 26084 A/80

[51] Int. Cl.[3] ..... C14B 1/14

[52] U.S. Cl. ..... 69/13

[58] Field of Search ..... 69/13, 11, 12, 9.3

[56] References Cited

U.S. PATENT DOCUMENTS

| | | | |
|---|---|---|---|
| 3,031,873 | 5/1962 | Brett | 69/13 |
| 4,210,051 | 7/1980 | Fingerle et al. | 69/13 |
| 4,253,318 | 3/1981 | Repetto | 69/13 |

*Primary Examiner*—Patrick D. Lawson

*Attorney, Agent, or Firm*—Karl F. Ross; Herbert Dubno

[57] ABSTRACT

The machine for splitting skins through their thickness to obtain two sheets, of which one is a flower sheet on the hairy side and the other a crust sheet on the flesh side, comprises the already known elements of annular endless band blade tensioned between continuously running wheels and upper and lower feed rollers, with the characteristic that the edge of the cutting blade at the cutting location always remains fixed in the same transverse position, except for takeup of wear due to cutting and sharpening, whereas the upper and lower feed rollers are displaced in the direction perpendicular to the blade and in the direction parallel to same, in order to adopt the correct positions for obtaining the desired thicknesses of said two parts of the skin, respecting the optimum conditions for removing the parts themselves from the cutting complex.

10 Claims, 3 Drawing Figures

MACHINE FOR SPLITTING SKINS

FIELD OF THE INVENTION

This invention relates to a machine for splitting skins through their thickness in order to obtain two separate sheets, that sheet having the hairy outer side being sometimes referred to as the flower or grain side sheet and the other inner or flesh side being sometimes known as the crust or split side sheet.

BACKGROUND OF THE INVENTION

Such a machine normally employs a continuous band blade tensioned between two revolving flywheels, means being provided for displacing feed rollers relative to the blade to enable the thickness of the flower or grain side sheet and of that on the crust or split side sheet to be varied depending upon the type of skins and their intended use.

Various types of such splitting machines can regulate the desired thickness of the flower or grain side of the skins by displacing both the feed rollers and the band blade in order to take into account certain specific parameters necessary for the correct cutting of the skin.

The basic elements which make up the known machines include a very rigid frame, to which are fitted two horizontal bridges, an upper one for carrying the feed roller and for compensating for the thickness of the skin and a lower one carrying a so-called rubberized feed and pressure roller and also a rings roller in contact with the flesh side of the skin. A longitudinal bench is disposed between the bridges to support and guide the band cutting blade which is tensioned between two lateral flywheels disposed at the ends of the bench.

In such known machines, in order to vary the thickness of the two parts cut from the skin, the upper and lower bridges and/or the related skin feed rollers are displaced in a direction perpendicular to that of the plane of the cutting blade, that is to say in the direction of the thicknesses of the two parts which it is desired to obtain, whereas the bench complex supporting the cutting blade is displaced in the transverse direction along the plane containing the upper face of the cutting blade, so as to enable the cutting edge of the blade to be displaced relative to the two feed rollers for the skin, to allow for the correct removal of the two parts of the skin from the cutting zone. Consequently in the known machines the support bench for the blade must satisfy two requirements: firstly taking up the reduction in the width of the blade due to the continued sharpening of same and to the cutting of the skin, and secondly displacing the entire blade into various positions in its plane, according to the thickness of the skin which it is desired to obtain and the latter implies that the support bench for the blade shall be displaceable with its entire assembly in the transverse direction relative to the upper and lower bridges so as correctly to position the cutting edge of the blade.

These requirements appreciably complicate the construction of the machine in that the transverse displacement of the blade demands the integral displacement of the supports for the blade itself, of the sharpening device, of the drive means with the related motors, and of the wheels on which the band is disposed, which wheels have to be not only rotationally driven but also longitudinally stressed to keep the band in tension during its cutting movement. To eliminate the disadvantages deriving from the aforementioned complexity of construction, the technical problem arises of being able to achieve correct cutting of the skins without the band blade support having to change its position relative to the frame of the machine.

OBJECTS OF THE INVENTION

It is an object of the present invention to provide a machine for splitting skins in which the support and guide bench for the band blade are fixed in the transverse direction relative to the frame, while the movements for varying the cutting thickness are all accomplished by the drive rollers for the skin.

A second object of the invention is to provide in a splitting machine the capability of displacing the feed rollers even during the operation of the machine.

A further object of the invention is to simplify the construction of the machine by eliminating the need for linearly displacing the cutting blade and the numerous related moving elements to accommodate variations in the thickness of the skin and variations in the thicknesses of the sheets to be split therefrom.

SUMMARY OF THE INVENTION

The present invention broadly stated provides a machine for splitting skins comprising an endless band blade having a cutting edge for splitting the skins at a cutting location, means for supporting the band blade with the cutting edge for travel along a fixed path at the cutting location, feed rollers arranged to bear against opposite faces of the skin to advance the skin towards the cutting edge at the cutting location in a direction normal to the direction of travel of the cutting edge and means for displacing the feed rollers in a first direction substantially parallel to the direction of advance of the skin and in a second direction normal to the first direction and to the path of travel of the cutting edge.

More specifically, the invention provides a splitting machine which comprises a rigid fixed base on which are mounted an upper bridge carrying the feed and compensating rollers and a lower bridge having the rubberized feed and pressure roller coupled to the rings roller, said rollers in turn being in contact respectively with the "flower" side and the "flesh" side of the skin being processed, said bridges, or parts of same associated with said feed rollers, being displaceable independently of one another in a direction parallel to the plane of the band blade and in a direction perpendicular to the said plane of said blade, the cutting stretch of the blade being supported and guided on a longitudinal bench integral with the cheek plates and fixed in a transverse direction, the cutting edge of said blade being kept fixed in position relative to the cheek plates even with the take-up of the wear due to the sharpening and consumption of the blade itself. The upper bridge can be hinge-connected at the upper side to the fixed cheek plates and can be angularly positioned by screw means or the like for displacement along an arc merging with the tangent parallel with the plane of the cutting blade, the upper drive roller being in contact with the skin being processed and, being displaceable by known means in a direction perpendicular to the plane of the cutting blade for adjusting the thickness of the part cut from the "flower" side. In an analogous manner the lower bridge is hinge-connected with the base and can be angularly positioned by eccentric means or the like for shifting the rings roller along an arc merging with the tangent parallel with the plane of the blade, said ring roller being displaceable in a direction perpendicular to the blade itself jointly with the beam of the bridge and the support plane for the skin for adjusting the thickness of cut on the "flesh" side.

As well as being hinged, the upper and lower bridges can be displaced in the direction parallel to the direction of the plane of the cutting blade by means of rectilinear guides and slides lying in planes parallel to said plane of the cutting blade. Also, it is preferred that the bench support for the cutting blade shall have a blade supporting part which can expand in the direction of travel of the blade by the heat generated while retaining the cutting edge at a fixed path of travel at the cutting location. For this purpose, such blade supporting part is desirably anchored at a point intermediate its length to permit expansion in opposite directions away from such anchoring point.

According to one embodiment of the invention there is provided a machine for splitting skins comprising a frame, a pair of spaced fixed cheek plates forming part of said frame, an endless band blade having a cutting edge for splitting the skins at a cutting location, support means secured to said cheek plates operable to support said band blade with said cutting edge for travel along a fixed path at said cutting location, first and second feed rollers arranged to bear respectively against upper and lower faces of said skin to advance said skin towards said cutting edge at said cutting location in a direction substantially normal to the direction of travel of said cutting edge at said cutting location, a first bridge member mounted on said cheek plates and displaceable about a first axis parallel to the direction of travel of said cutting edge at said cutting location, means mounting said first feed roller in said first bridge member for displacement therewith, screw means operably associated with said first bridge member and said frame for adjustment of the said first bridge member about said first axis to displace said first feed roller along an arc of sufficient radius to displace said first feed roller in a first direction substantially parallel to the direction of advance of said skin, first means operable to displace said first feed roller in a second direction normal to said first direction and to the path of advance of said skin at said cutting location, a second bridge member mounted on said cheek plates, means mounting said second feed roller on said second bridge member for displacement therewith, a fluid pressure operated piston and cylinder arrangement forming part of said second bridge member and operable to displace said second feed roller in said second direction, means mounting said piston and cylinder arrangement on said frame for angular displacement about a second axis parallel to the direction of travel of said cutting edge at said cutting location to displace said second feed roller along an arc of sufficient radius to displace said second feed roller in said first direction substantially parallel to the direction of advance of said skin and support means for supporting said band blade at said cutting location and comprising a first part fixedly mounted on said frame and a second part anchored to said first part and capable of thermal expansion in a direction parallel to the direction of travel of said band blade.

DESCRIPTION OF THE PREFERRED EMBODIMENT

Figure 1:
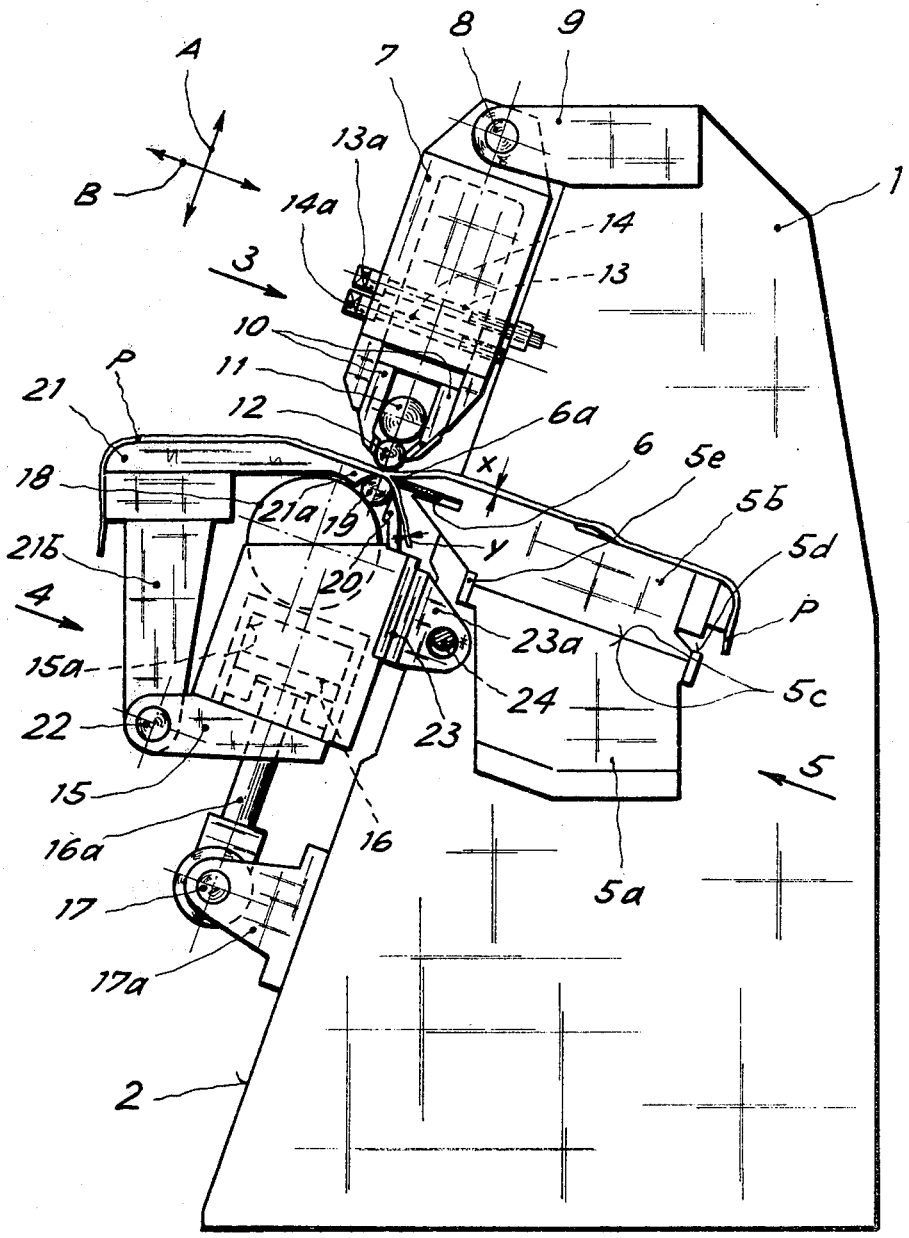
FIG. 1 is a diagrammatic side view of the general structure and of the principal elements of a splitting machine according to the invention.

Referring to FIG. 1, the machine comprises two spaced lateral cheek plates 1 (one shown) forming a rigid base or frame having a substantially planar front face 2 inclined upwardly towards the rear, to which are fitted the working members, viz. an upper bridge generally indicated at 3 and a lower bridge generally indicated at 4, both bridges being inclined substantially parallel to the front face 2 of the cheek plates 1. Between the cheek plates 1 there is disposed a longitudinally extending bench generally indicated at 5, which extends rearwardly and downwardly and possesses an upper working surface substantially perpendicular to the inclined front face 2. As so far described, the combination of the three members, comprising the upper brige 3, the lower bridge 4 and the longitudinal bench 5 and the functions thereof are already known in splitting machines for skins using an endless band blade. Basically, the upper bridge 3 fulfills the function of reacting to the pressure exerted upon the skin P being processed and of driving the upper or outer face of same, the lower bridge 4 fulfills the function of exerting a pressure upon the skin P and of driving same onto the cutting blade and the longitudinal bench 5 holds in position the upper run of the cutting blade 6, which is shaped in known manner as a closed or continuous band and is tensioned between two lateral wheels (not shown) which cause the blade itself to travel at the cutting location in the longitudinal direction while maintaining the continuous band in a plane substantially perpendicular to the direction of feed of the skin P.

Also in known manner, the cutting blade 6 is continuously sharpened before arriving at the cutting location, by means of known equipment not shown here, and consequently it is continually reduced in its transverse dimension in relation to the wear to which it is subjected. The take-up of the wear of the blade is furthermore effected in known manner by known means, omitted here in order to simplify the drawing.

According to one feature of the invention, the longitudinal blade-carrying bench 5 is composed of a lower beam 5*a* integrally fixed between the cheek plates 1 and of an upper beam 5*b*, which supports and guides the blade 6 in a slidable manner. The upper beam 5*b* rests upon the lower beam 5*a* at a dividing plane 5*c* and is restrained against displacement in the direction parallel to the direction of feed of the skin by two opposed guides 5*d* and 5*e* in such a manner that the upper beam 5*b* can slide in a longitudinal direction relative to the fixed lower beam 5*a* and parallel to the direction of travel of the cutting blade but cannot move in the transverse direction. Such a dividing of the longitudinal beam 5 is provided, according to the invention, to permit the upper beam 5*a*, which supports and guides the blade 6, to expand freely in the longitudinal direction parallel to the direction of travel of the blade 6 at the cutting location as a consequence of the heat generated by the friction on the blade, whereas it remains in a fixed position in the transverse direction in order to keep the edge 6*a* of the cutting blade 6 always in the same position at the cutting location relative to the plane of the front face 2 of the cheek plates 1.

With advantage it is provided that the upper beam 5*b* of the longitudinal beam 5 is anchored to the fixed lower beam 5*a* intermediate its length in a central position in such a manner that the upper beam 5*b* can expand freely away from such anchoring point in opposite directions towards the two cheek plates 1. However, according to the invention, the cutting edge 6*a* of the cutting blade 6 travels along a fixed path relative to the cutting location and the substantially flat blade 6 at the cutting location lies in a plane inclined rearwardly and downwardly from the cutting location, and substantially perpendicular to the plane of the front faces 2 of the cheek plates 1. In relation to the cutting edge 6*a* and the plane of the front faces 2, the upper bridge 3 and lower bridge 4 are arranged in such a way that they can be displaced both in a direction parallel to the plane of the front faces 2, i.e., in the direction of the arrows A, and also in a direction perpendicular to such plane, i.e., in the direction of the arrows B. The direction of the arrow B is parallel to the direction of feed of the skin P and the direction of the arrow A is normal to the direction of the arrow B and to the path of travel of the cutting edge 6*a*.

More precisely, considering that the face of the blade 6 (which is substantially rectangular in cross section) at the cutting location lies on a plane substantially perpendicular to the plane of the faces 2, it is provided according to the invention that the elements which cooperate in the cutting of the skin and are in contact with same and forming part of said two bridges 3 and 4 can be displaced both in a direction perpendicular to the blade 6 (arrows A), approaching or moving away from same, or be displaced in a direction parallel to the blade (arrow B), toward or away from the edge 6*a* of the blade 6, each on its own account. Such displacements of the two upper and lower bridges 3 and 4 can be achieved in a general way in any desired manner, for example by translatory movements parallel to the plane of the face of the blade 6 combined with translatory movements parallel to the plane of the faces 2 obtained by guides in the two directions, or by rotary angular movements of a large radius combined with rectilinear translatory movements, or finally by both movements being of a angular type.

In the embodiment illustrated, the movements of the two bridges are obtained by means of linearly guided displacements in the direction of the arrow A (perpendicular to the blade 6 and to the direction of feed of the skin P) and by displacements along arcs of circles in the direction of arrow B. As will be explained below, however, said displacements along arcs of circles referred to the points of contact with the skin being processed are very small by comparison with the value of the radii of rotation of the arcs themselves, with the result that such radii are sufficiently large that said arcs can merge with the tangent and be considered substantially linear. In conjunction with the fact that said centre of rotation of the two bridges 3 and 4 are substantially perpendicular to the plane of the blade 6, it follows that said arc-shaped displacements are virtually rectilinear and parallel to the face of the blade itself.

With reference to FIG. 1, it is the case therefore that the upper bridge 3 is composed of an upper beam hinged at the top to a shaft 8 integral with the brackets 9 of the cheek plates 1, said beam having at its lower end parallel guides 10 containing the compensating rollers 11 and a driving and opposing roller 12. The roller 12 is therefore angularly displaceable about a first axis which is the axis of the shaft 8 and which extends parallel to the direction of travel of the cutting edge 6*a* at the cutting location.

Said guides, compensating and driving rollers respectively 10, 11, 12 are themselves known and are mounted in special supports, not shown, so that they may be displaced linearly parallel the arrows A perpendicularly to the plane of the blade 6. On the body of the beam 7, at one or more points relative to the front plane 2, there are provided angular positioning means for the beam itself with respect to the rotational axis 8, constituted for example of a pulling screw 13 and a pushing screw 14 acting between the bridge 3 and the frame so that by acting on one or the other by means of spanners or the like for their external prismatic ends 13*a*, 14*a* it is possible to fix the desired position of the feeding and opposing roller 12 relative to the cutting edge 6*a* of the blade 6.

The variation in said position is small by comparison with the distance from the axis of rotation about the shaft 8, so that the arciform travel of the contact point of the roller 12 with the skin P can be merged with the tangent at the same point to the arc having its center at the axis of the shaft 8.

Said lower bridge 4 comprises in turn a lower beam 15 carrying at each end a cylinder 15*a*, in which there slides a piston 16 the piston rod 16*a* of which is carried on the frame by brackets 17*a* mounted on the cheek plates 1 for angular displacement about a lower axis 17. The lower base 15 supports a motor-driven, horizontal, rubber-tire roller 18 of known type, on which there rests a rings roller 19, free to rotate and restrained in the feed direction of the skin P by a pointed straightedge 20 and at the rear portion by the end 21*a* of a support plate 21 having arms 21*b* hingedly connected to the lower beam 15 for angular displacement about an axis 22 parallel to the axis 17.

The beam 15, rollers 18, 19, straightedge 20 and support plate 21 can slide in a direction parallel to the plane of the face 2 by means of rectilinear guides 23 which are integral with supports 23*a* which are connected to the cheek plates 1 by means of eccentrics 24 disposed at the free ends of the lower beam 15 or at some other point of the frame. With such an arrangement the complex integral with said beam 15 can be displaced axially in the direction of arrows A, by supplying pressurized fluid into the cylinder 15*a* to cause the rings roller 19 to approach or move away from the cutting edge 6*a* of the blade 6 in the direction perpendicular to the plane of the face of the blade 6, and can be displaced in the direction of arrows B by causing this assembly to oscillate about the axis 17 by rotation of the eccentrics 24, with the result that the end of the rings roller 19 in contact with the skin P must follow an arc of a circle having its centre at the axis 17 which nevertheless, due to the large ratio of such displacement to the radius, can be assimilated to the tangent at the same point to the same arc.

Figure 3:
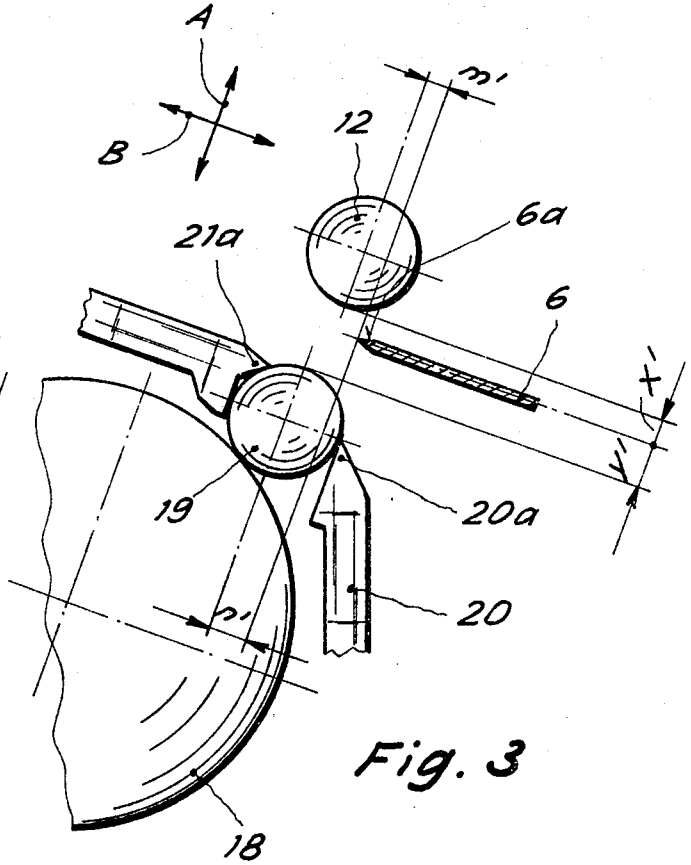
FIG. 3 shows the same parts of the elements of FIG. 2 displaced to a different position.
Figure 2:
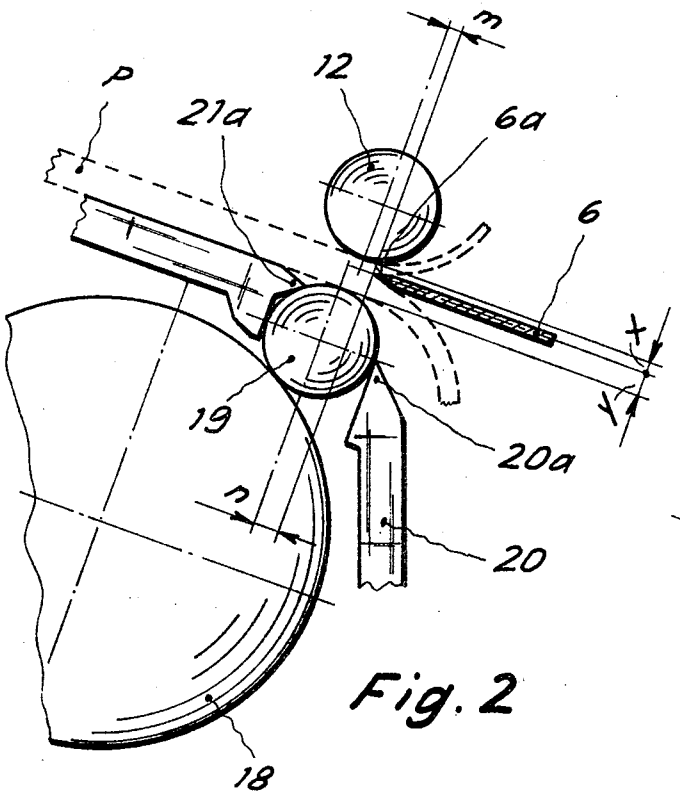
FIG. 2 is an enlarged and diagrammatic view showing parts of the elements, which participate in the cutting of the skin, disposed in an operating position.

Referring to FIGS. 2 and 3, we see the arrangement of the parts in the cases of cuts of different thicknesses obtainable by the splitting machine according to the present invention, noting that the position of the feed and opposition roller 12 and that of the feed and pressure roller 19 must comply with certain parameters in relation to the cutting edge 6*a* of the blade 6. Looking at FIG. 2, it can be seen that, as known, when it is necessary to cut a skin P of thickness $x+y$ into two parts x and y by the band blade 6, of which the upper part with the x dimension is on the flower or grain side and the lower part with the y dimension is on the flesh side, commonly known as crust, it is necessary for the cutting edge 6*a* to be at a certain distance m from the feed and opposition roller 12 and at a distance n from the feed and pressure roller 19, such distances m and n being measured in the direction of the arrow B. Said parameters, as is known, are dependent upon the thicknesses into which the skin P must be divided, in that the two parts of the skin must be able to pass easily between the end of the blade 6 with related guide support and drive rollers, bearing in mind that on the part divided on the flesh side, that is for the crust, it is necessary for the straightedge 20 in contact with the rings roller 19 to offer its own scraping point 20*a* in the position found to be optimum in diametral contact to favor removal of the cut part without causing cuts of flesh or the like between the scraping point 20*a* and the rings rollers 19.

FIG. 3 shows the same elements as FIG. 2, but displaced in the direction of the arrows A (perpendicularly to the plane of the face of the blade 6), the roller 12 being displaced upwards to increase the distance x to x' for the part of the skin on the flower side and the roller 19 being displaced downwards to increase the thickness y to y' for the part of the skin on the crust side, and being also displaced in the direction of the arrows B, that is parallel to the plane of the face of the blade 6 in the direction to increase to m' the distance of the cutting edge 6*a* from the center of the roller 12 and to increase to n' the distance of the same cutting edge 6*a* from the centre of the rings roller 19, while said cutting edge 6*a* of the blade 6 is kept in a fixed position at the cutting location, the wear of the edge 6*a* being taken up in known manner, as stated. The method of functioning is as follows:

If it is desired to cut a skin P into two parts, one on the flower (upper) side of thickness x and the other on the crust (lower) side of thickness y, the fixed position of the cutting edge 6*a* of the blade 6 is completely defined and therefore the upper bridge complex 3 comprising the compensating roller 11 and the feed and opposition roller 12 is displaced in known manner in the direction of arrows A and, by appropriately operating the pulling screw 13 and pushing screw 14, in the direction of arrows B, to determine the position of the roller 12 and the dimensions x and m required by the desired cutting of the flower side of the skin. Furthermore there are carried out with the lower bridge complex 4, comprising the feed and pressure roller 18 with which the rings roller 19 is in contact, the displacement of the beam 15 together with the related members in the direction of arrows A by supplying pressurized fluid into the cylinder 15*a* and the displacement in the direction of arrows B by rotating the eccentric 24 for the purpose of determining the desired distances y and n for correct cutting of the crust. The variation of said parameters relating to the cutting of the skin can be carried out also by acting upon the cylinder 15*a* for the thickness and the eccentric 24 for the position of the roller relative to the blade, bearing in mind that the measurements m and n may be different from one another and from m' and n' due to the independence of the displacements of the bridges 3, 4.

As mentioned earlier, the displacement along the plane of the face of the blade (arrow B) of the upper and lower bridges can be obtained also by means of rectilinear guides parallel to the blade itself, instead of the arcuate movements illustrated, by mounting said two bridges on appropriate slides and by carrying out the displacement with appropriate means of known type with constructional applications.

Also in this case the variations of the parameters required for cutting the skin would be carried out solely on the elements of said bridges without displacing the position of the edge of the cutting blade, thus achieving the advantages illustrated.

It will be understood that further variations of a constructional or design nature, especially tending to adapt the various elements to the type of machine to which they are to be applied, can be carried out without thereby departing from the scope of the present invention.

What is claimed is:

1. A machine for splitting skins comprising:

an endless band blade having a cutting edge for splitting the skins at a cutting location;

means for supporting the band blade with the cutting edge for travel along a fixed path at the cutting location;

feed rollers arranged to bear against opposite faces of the skin to advance the skin towards the cutting edge at the cutting location in a direction normal to the direction of travel of the cutting edge; and means for displacing the feed rollers in a first direction substantially parallel to the direction of advance of the skin and in a second direction normal to the first direction and to the path of travel of the cutting edge, one of said feed rollers being arranged to bear against one face of the skin, a first bridge member carrying said one feed roller and being mounted for angular displacement about an axis parallel to the direction of travel of said band blade at said cutting location, and displacing means being provided and operable angularly to displace said first bridge member about said axis and displace said one feed roller along an arc of sufficient radius to displace said one feed roller in said first direction substantially parallel to the direction of advance of the skin.

2. A machine according to claim 1 further comprising a frame, means mounting said first bridge member on said frame for angular displacement about said axis, and screw means adjustably engageable between said frame and said first bridge member to adjust said angular displacement.

3. A machine according to claim 1 further comprising a frame, an eccentric member, mounted on said frame, and means mounting said first bridge member on said frame in operative engagement with said eccentric member for angular displacement about said axis.

4. A machine for splitting skins comprising:

an endless band blade having a cutting edge for splitting the skins at a cutting location;

means for supporting the band blade with the cutting edge for travel along a fixed path at the cutting location;

feed rollers arranged to bear against opposite faces of the skin to advance the skin towards the cutting edge at the cutting location in a direction normal to the direction of travel of the cutting edge; and means for displacing the feed rollers in a first direction substantially parallel to the direction of advance of the skin and in a second direction normal to the first direction and to the path of travel of the cutting edge, rectilinear guides and slides and means operatively supporting at least one of said feed rollers in said guides and slides for displacement in one of said first and second directions.

5. A machine for splitting skins comprising:

an endless band blade having a cutting edge for splitting the skins at a cutting location;

means for supporting the band blade with the cutting edge for travel along a fixed path at the cutting location;

feed rollers arranged to bear against opposite faces of the skin to advance the skin towards the cutting edge at the cutting location in a direction normal to the direction of travel of the cutting edge; and means for displacing the feed rollers in a first direction substantially parallel to the direction of advance of the skin and in a second direction normal to the first direction and to the path of travel of the cutting edge, said band blade supporting means comprising a bench member having at least a fixed first part and a second part mounted on said first part for sliding movement relative thereto in a direction parallel to the direction of travel of the cutting edge to accommodate thermal expansion.

6. A machine according to claim 5 in which said second part of said bench member is anchored at a point intermediate its length to said first part thereof with portions of said first part extending on opposite sides of said anchoring point in the direction of travel of said band blade at said cutting location to permit thermal expansion of said first part portions in opposite directions away from said anchoring point in said direction of travel of said band blade at said cutting location.

7. A machine according to claim 1 further comprising a frame, a fluid operated piston and cylinder arrangement mounted on said frame for angular displacement about said axis, and means mounting said one feed roller on said cylinder of said piston and cylinder arrangement, said piston and cylinder arrangement being operable to displace said one feed roller in said second direction and being angularly displaceable to displace said one feed roller in said first direction.

8. A machine according to claim 7 further including an eccentric member carried on said frame in engagement with said piston and cylinder arrangement and operable angularly to displace said piston and cylinder arrangement about said axis.

9. A machine according to claim 1 further including a support plate for supporting the skin as it is advanced towards said cutting edge and means mounting said support plate on said piston and cylinder arrangement.

10. A machine for splitting skins comprising a frame, a pair of spaced fixed cheek plates forming part of said frame, and endless band blade having a cutting edge for splitting the skins at a cutting location, support means secured to said cheek plates operable to support said band blade with said cutting edge for travel along a fixed path at said cutting location, first and second feed rollers arranged to bear respectively against upper and lower faces of said skin to advance said skin towards said cutting edge at said cutting location in a direction substantially normal to the direction of travel of said cutting edge at said cutting location, a first bridge member mounted on said cheek plates and displaceable about a first axis parallel to the direction of travel of said cutting edge at said cutting location, means mounting said first feed roller in said first bridge member for displacement therewith, screw means operably associated with said first bridge member and said frame for adjustment of the said first bridge member about said first axis to displace said first feed roller along an arc of sufficient radius to displace said first feed roller in a first direction substantially parallel to the direction of advance of said skin, first means operable to displace said first feed roller in a second direction normal to said first direction and to the path of advance of said skin at said cutting location, a second bridge member mounted on said cheek plates, means mounting said second feed roller on said second bridge member for displacement therewith, a fluid pressure operated piston and cylinder arrangement forming part of said second bridge member and operable to displace said second feed roller in said second direction, means mounting said piston and cylinder arrangement on said frame for angular displacement about a second axis parallel to the direction of travel of said cutting edge at said cutting location to displace said second feed roller along an arc of sufficient radius to displace said second feed roller in said first direction substantially parallel to the direction of advance of said skin and support means for supporting said band blade at said cutting location and comprising a first part fixedly mounted on said frame and a second part anchored to said first part and capable of thermal expansion in a direction parallel to the direction of travel of said band blade.

* * * * *